US009824812B2

(12) United States Patent
Huang et al.

(10) Patent No.: US 9,824,812 B2
(45) **Date of Patent: *Nov. 21, 2017**

(54) INTEGRATED STACKED TRANSFORMER

(71) Applicant: Realtek Semiconductor Corp., HsinChu (TW)

(72) Inventors: Kai-Yi Huang, Taipei (TW); Hsiao-Tsung Yen, Hsinchu (TW); Yuh-Sheng Jean, Hsinchu County (TW); Ta-Hsun Yeh, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 93 days.

This patent is subject to a terminal disclaimer.

(21) Appl. No.: 14/658,255

(22) Filed: Mar. 16, 2015

(65) Prior Publication Data

US 2015/0270054 A1 Sep. 24, 2015

(30) Foreign Application Priority Data

Mar. 19, 2014 (TW) ..... 103110339 A

(51) Int. Cl.
*H01F 5/00* (2006.01)
*H01F 27/28* (2006.01)
*H01F 19/04* (2006.01)

(52) U.S. Cl.
CPC ..... *H01F 27/2804* (2013.01); *H01F 5/00* (2013.01); *H01F 19/04* (2013.01); *H01F 2027/2809* (2013.01)

(58) Field of Classification Search
CPC ..... H01F 5/00; H01F 27/00–27/30
USPC ..... 336/65, 200, 232
See application file for complete search history.

(56) References Cited

U.S. PATENT DOCUMENTS

| | | | | |
|---|---|---|---|---|
| 7,482,904 | B2 * | 1/2009 | Lee | H03H 7/42 336/200 |
| 2006/0077028 | A1 * | 4/2006 | Huang | H01F 17/0006 336/223 |
| 2009/0152674 | A1 * | 6/2009 | Uchida | H01L 23/5227 257/531 |
| 2011/0032065 | A1 * | 2/2011 | Raczkowski | H01F 27/2804 336/200 |
| 2013/0267185 | A1 * | 10/2013 | Chen | H04B 1/44 455/78 |

FOREIGN PATENT DOCUMENTS

| | | | |
|---|---|---|---|
| CN | 1405801 | A | 3/2003 |
| CN | 102760563 | A | 10/2012 |

* cited by examiner

*Primary Examiner* — Tuyen Nguyen
(74) *Attorney, Agent, or Firm* — Winston Hsu

(57) ABSTRACT

An integrated stacked transformer includes a primary winding, a secondary winding and a plurality of bridges, wherein the primary winding is formed by a first metal layer and includes a plurality of segments that are not electrically connected to each other; the secondary winding is form by a second metal layer and includes a plurality of segments that are not electrically connected to each other; the plurality of bridges are formed by a third metal layer. A portion of the bridges is connected to the segments of the primary winding respectively to make the segments of the primary winding form a primary inductor; and another portion of the bridges is connected to the segments of the secondary winding respectively to make the segments of the secondary winding form a secondary inductor.

11 Claims, 11 Drawing Sheets

INTEGRATED STACKED TRANSFORMER

BACKGROUND OF THE INVENTION

1. Field of the Invention

This present invention is related to a transformer, and more particularly, to an integrated stacked transformer.

2. Description of the Prior Art

Transformer and balun are the important elements in radio frequency integrated circuit to achieve single end to differential conversion, signal coupling, and impedance matching, etc. With integrated circuit developing toward system on chip (SOC), integrated transformer/balun replaces traditional discrete element gradually and is applied in radio frequency integrated circuit widely. However, the passive elements in integrated circuit such like inductor and transformer consume a lot of chip area in general, therefore how to reduce the amount of passive element in integrated circuit and minimize the area of passive element and maximize the specification of element like quality factor Q and coupling coefficient K is an important issue.

SUMMARY OF THE INVENTION

One of the objectives of the present invention is providing an integrated stacked transformer, which has high quality factor and coupling coefficient and uses less metal layers to reduce the manufacturing costs and maximizes the specification of element.

According to an embodiment of the present invention an integrated stacked transformer comprises a primary winding, a second winding and a plurality of bridges, wherein the primary winding is formed by a first metal layer and comprises a plurality of segments that are not electrically connected to each other; the second winding is formed by a second metal layer and comprises a plurality of segments that are not electrically connected to each other; and the plurality of bridges are formed by a third metal layer. A portion of the bridges are connected to the segments of the primary winding respectively to make the segments of the primary winding form a primary inductor; and the other portion of the bridges are connected to the segments of the secondary winding respectively to make the segments of the secondary winding form a secondary inductor.

According to another embodiment of the present invention an integrated stacked transformer comprises a primary winding, a secondary winding and at least two tertiary windings, wherein the primary winding is formed by a first metal layer, the secondary winding is formed by a second metal layer and the two tertiary windings are formed by a third metal layer, wherein the third metal layer is disposed between the first metal layer and the second metal layer. One of the two tertiary windings is electrically connected to the primary winding and the other is electrically connected to the secondary winding, and the two tertiary windings are electrically isolated from each other.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
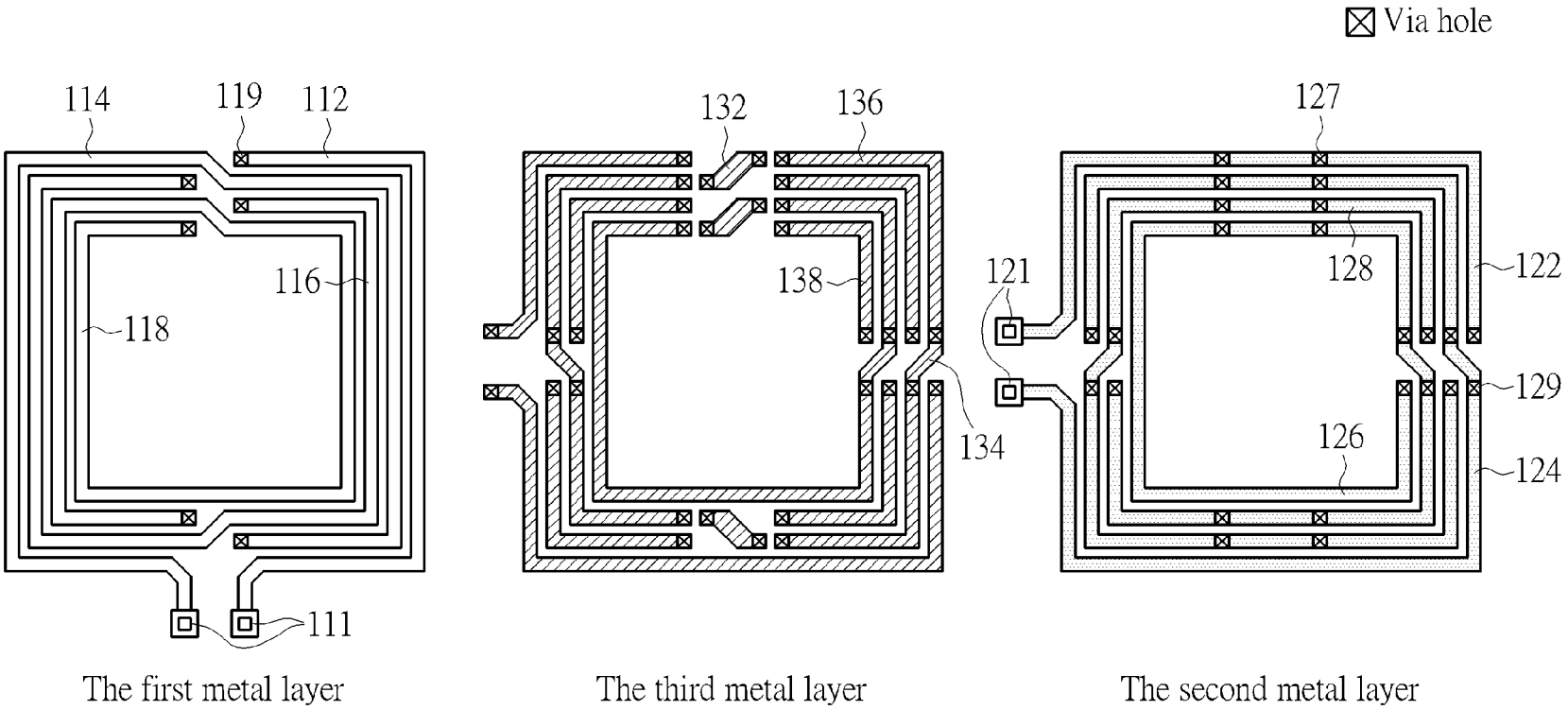
FIG. 1A is a diagram illustrating the patterns of three metal layers of integrated stacked transformer according to an embodiment of the present invention.
Figure 1B:
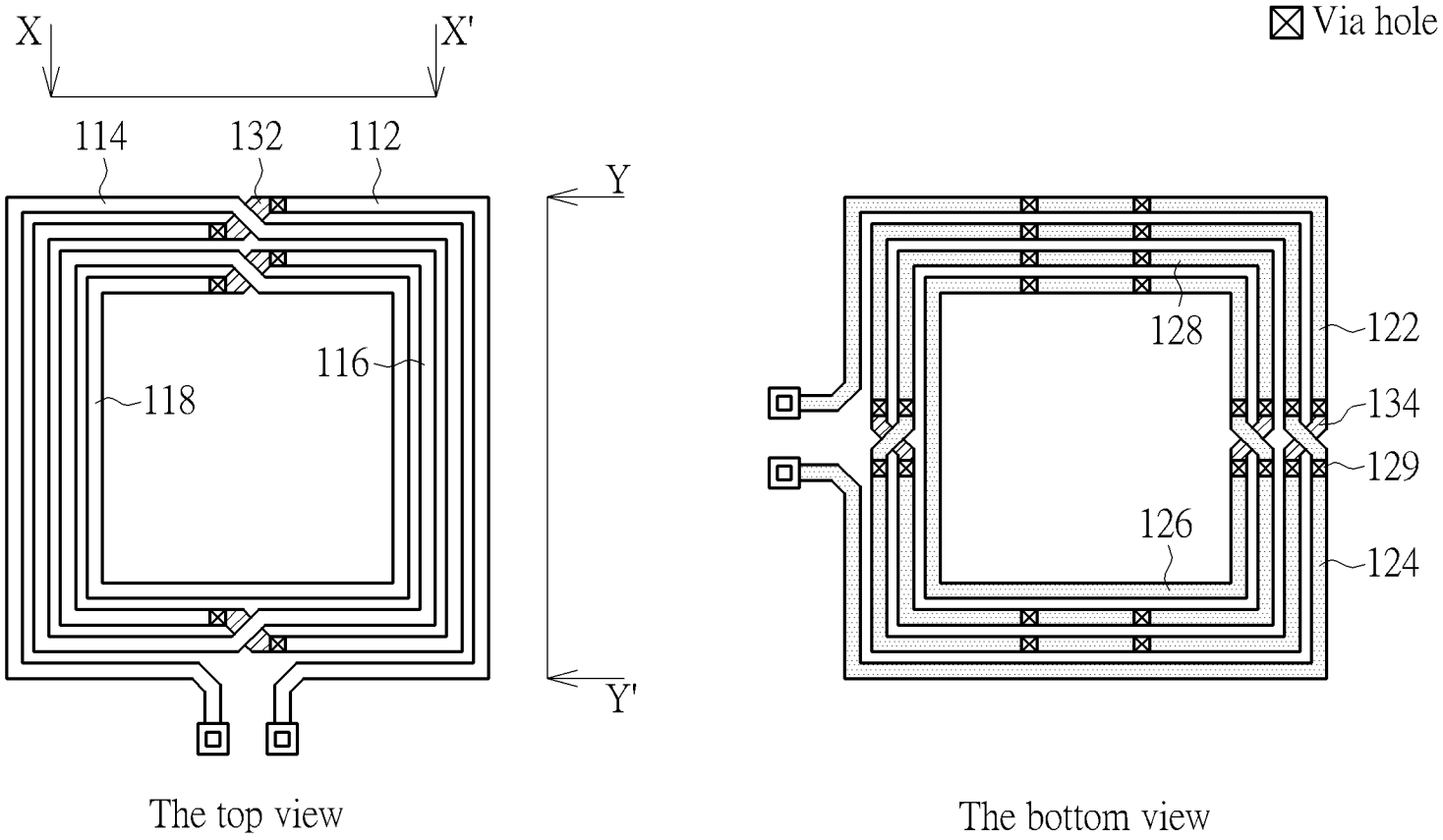
FIG. 1B is a diagram illustrating the top view and the bottom view of the integrated stack transformer in FIG. 1A.
Figure 1C:
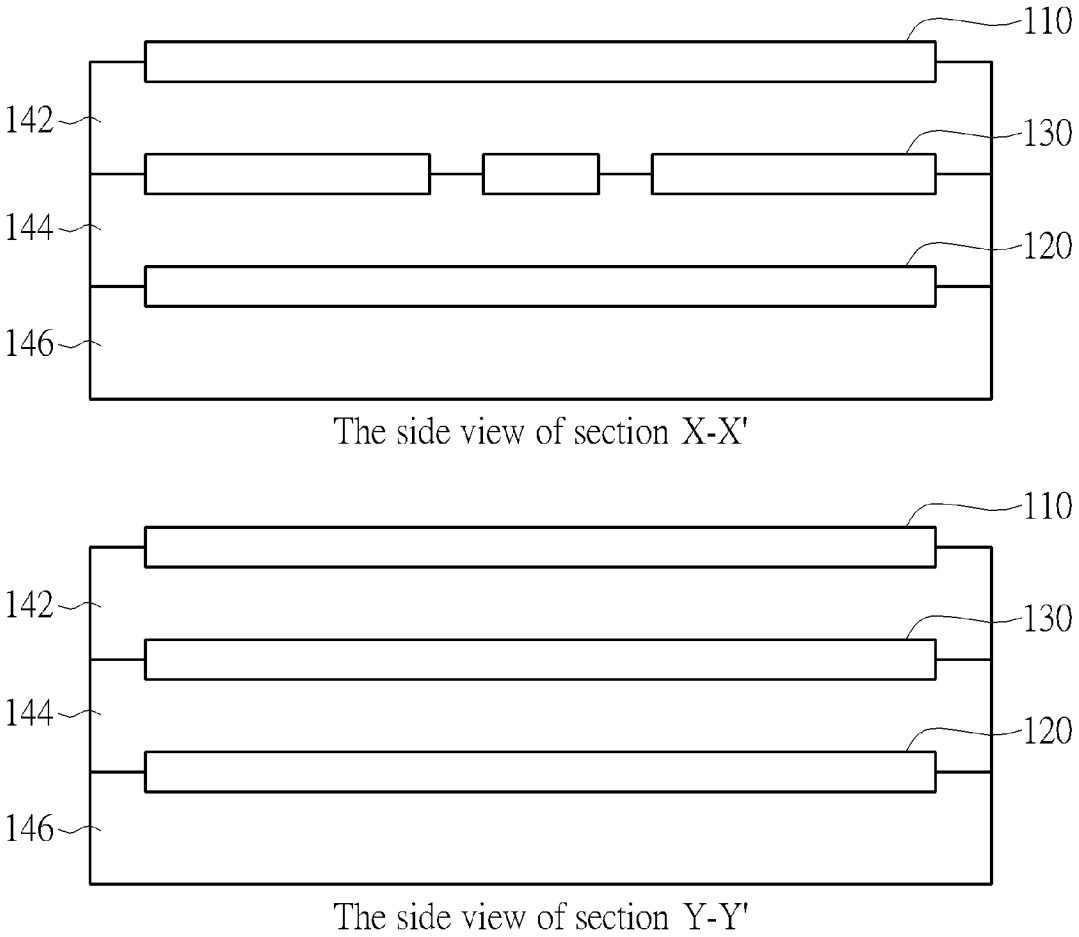
FIG. 1C is a diagram illustrating the side view of section X-X' and section Y-Y' of the top view in FIG. 1B.

Refer to FIG. 1A, FIG. 1B and FIG. 1C, wherein FIG. 1A is a diagram illustrating the patterns of three metal layers of the integrated stacked transformer according to an embodiment of the present invention, FIG. 1B is a diagram illustrating the top view and the bottom view of the integrated stacked transformer according to an embodiment of the present invention, and FIG. 1C is a diagram illustrating the side view of integrated stacked transformer according an embodiment of the present invention. The integrated stacked transformer in this embodiment can be applied to be a transformer or balun in radio frequency integrated circuit.

The integrated stacked transformer in this embodiment, refer to FIG. 1A, is formed by three metal layers, wherein the diagram of the first metal layer in FIG. 1A is a primary winding, which comprises two input/output ports 111 and a plurality of segments 112, 114, 116, 118 that are not electrically connected to each other, where each segment comprises at least one via hole 119. The diagram of the second metal layer in FIG. 1A is a secondary winding, which comprises two input/output ports 121 and a plurality of segments 122, 124, 126, 128 that are not electrically connected to each other, where each segment comprises at least one via hole, for example the via holes 127 and 129 in FIG. 1A; In addition, the diagram of the third metal layer comprises a plurality of bridges (for example the bridges 132 and 134 in FIG. 1A) and a plurality of tertiary windings (for example the tertiary windings 136 and 138 in FIG. 1A). Furthermore, in this embodiment the third metal layer is disposed between the first metal layer and the second metal layer.

Next, refer to FIG. 1A and FIG. 1B. In the top view of FIG. 1B, each segment 112, 114, 116, 118 of the primary winding is connected to the bridge formed by the third metal layer (for example the bridge 132 in FIG. 1A and FIG. 1B) through via holes respectively, and is electrically connected to another segment of the primary winding through the bridges. For example the segment 112 in FIG. 1A and FIG. 1B can be electrically connected to segment 116 through the bridge 132. Each segment 112, 114, 116, 118 of the primary winding will be connected together through the bridges to form a primary inductor.

In addition, in the bottom view of FIG. 1B, each segment 122, 124, 126, 128 of the secondary winding is connected to the bridge formed by the third metal layer (for example the bridge 134) through via holes respectively, and is electrically connected to another segment of the secondary winding through the bridges. For example the segment 122 in FIG. 1B can be electrically connected to the segment 128 through the bridge 134. Each segment 122, 124, 126, 128 of the secondary winding will be connected together through the bridges to form a secondary inductor, wherein the secondary inductor is electrically isolated from the primary inductor.

In the top view of FIG. 1B, it only depicts the primary winding and the third metal layer which is directly connected to the primary winding but the second metal layer and the entire third metal layer for the tidiness of figure. In the bottom view of FIG. 1B, it also only depicts the secondary winding and the third metal layer which is directly connected to the secondary winding but the primary winding and the entire third metal layer for the same reason. The windings in the first metal layer, the second metal layer and the third metal layer of the integrated stacked transformer in FIG. 1A are overlapped except the bridges and the input/output ports in this embodiment.

In addition, FIG. 1C is a diagram illustrating the section view X-X' and the section view Y-Y' of the top view of FIG. 1B. The first metal layer 110, the third metal layer 130 and the second metal layer 120 are isolated from other metal layers by the dielectric layers 142, 144 and 146 respectively in FIG. 1C.

As shown in FIG. 1A, FIG. 1B and FIG. 1C, the bridges of the integrated stacked transformer which are connected to either the primary winding or the second winding are manufactured by the same metal layer (i.e. the third metal layer 130) in this embodiment, therefore the integrated stacked transformer in this embodiment can be achieved with only three metal layers, which can reduce the manufacturing costs indeed.

The windings in FIG. 1A, FIG. 1B and FIG. 1C are concentric and at least partly overlapped from top view.

Although the integrated staked transformers are achieved with only three metal layers in FIG. 1A, FIG. 1B, and FIG. 1C, it is not a limitation for this invention. In other embodiments of this present invention, refer to FIG. 1C, additionally it can dispose a plurality of metal windings which are similar with the primary winding above the first metal layer, wherein the plurality of windings are achieved by other metal layers respectively and connected to each other to form a parallel connection to reduce the resistance of the primary winding and increase the quality factor Q. In addition, additionally it can dispose a plurality of metal windings which are similar with the secondary winding underneath the second metal layer, wherein the plurality of metal windings are achieved by other metal layers respectively and connected to each other to form a parallel connection to reduce the resistance of the secondary winding and increase the quality factor Q. As long as the first metal layer 110 and the second metal layer 120 use the same metal layer (i.e. the third metal layer 130) as bridges, these alternative designs should fall within the scope of this invention.

In addition, in the diagram of the third metal layer in FIG. 1A also comprises a plurality of tertiary windings (for example tertiary windings 136 and 138 in FIG. 1A) and the two ports of each tertiary winding are connected to the segments of secondary winding 122, 124, 126, and 128 through via holes respectively. More particularly in the diagram of the third metal layer in FIG. 1A, except a plurality of bridges (for example the bridges 132 and 134) and necessary saving space, other spaces are used to manufacture a plurality of tertiary windings, wherein the patterns of the plurality of tertiary windings are substantially identical with the patterns of the secondary winding, which means for the third metal layer in FIG. 1A, except for the plurality of bridges, the patterns of the rest of the third metal layer are identical with the patterns of the secondary winding. Owing to the patterns of the tertiary windings are highly similar with the secondary winding and are connected to the secondary winding through a plurality of via holes, the tertiary windings can be regarded as connecting with the secondary winding in parallel and reduce the resistance of the secondary winding and increase the quality factor Q further.

In light of above, the third metal in this embodiment except for being the bridges to connect either the segments of the primary winding or the segments of the secondary winding, they also can be manufactured to connect with the secondary winding in parallel. Therefore, the third metal layer is effectively utilized to reduce the manufacturing costs and enhance the specification of element indeed.

The integrated stacked transformers in FIG. 1A, FIG. 1B and FIG. 1C are for illustrative purposes only, not a limitation of this present invention. In another embodiment of the present invention, the third metal layer in FIG. 1A can only comprises the bridges (for example the bridges 132 and 134 in FIG. 1A) but any tertiary winding (for example the tertiary windings 136 and 138 in FIG. 1A), which means the tertiary windings in FIG. 1A (for example the tertiary windings 136 and 138) can be removed without affecting any practical operation of the integrated stacked transformer. This alternative design shall fall within the scope of this present invention.

Figure 1D:
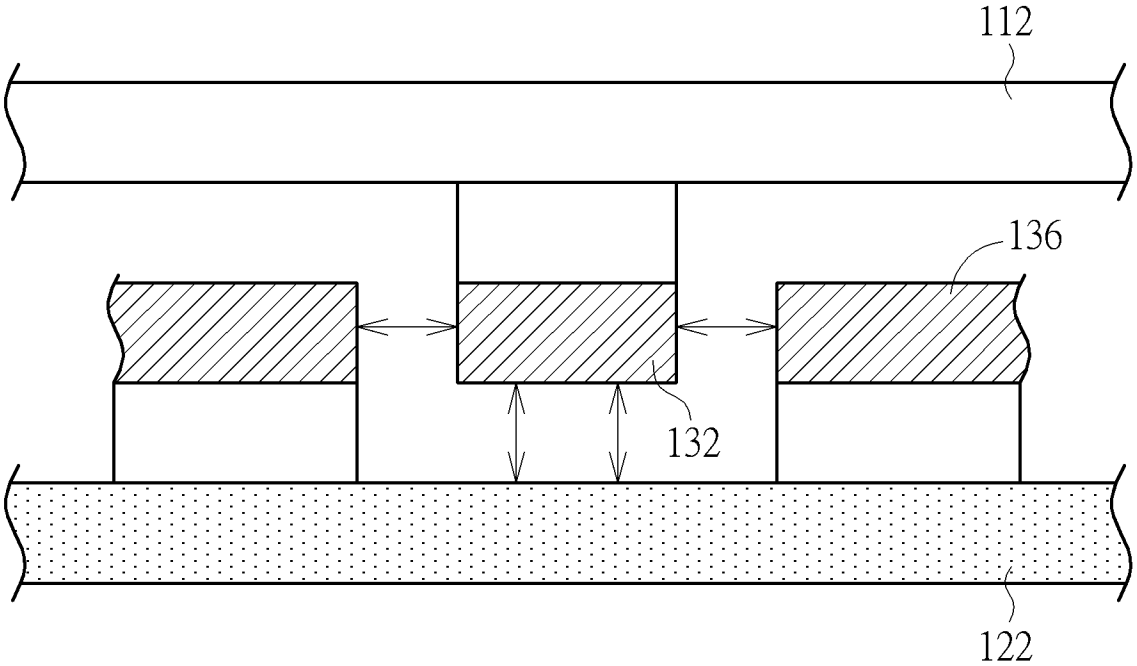
FIG. 1D is a diagram illustrating a section view around the bridge 132 in FIG. 1A and FIG. 1B.

In addition, refer to FIG. 1D, which is the section view around the bridges 132 of FIG. 1A and FIG. 1B. Refer to FIG. 1A and FIG. 1B, the segment 112 of the primary winding is electrically connected to the bridge 132 through via hole in FIG. 1D, and the segment 122 of the secondary winding is electrically connected to the tertiary winding 136 (or the tertiary winding 138) through via hole. Therefore this architecture can increase the coupling area between the primary winding and the secondary winding (or between the primary inductor and the secondary inductor) which is indicated by the double arrows in the FIG. 1D, and/or reduce the coupling distance between the primary winding and the secondary winding (or between the primary inductor and the secondary inductor) and increase the coupling coefficient, improve the specification of element. The inductance of the secondary inductor formed by the secondary winding and the tertiary windings will increase or the parasitic resistance of the secondary inductor will decrease. In addition, in an embodiment a portion of the tertiary windings can be connected to the primary winding through the bridges or via holes to form the primary inductor and a portion of the tertiary windings can be connected to the secondary to form the secondary inductor instead of entirely being used for the secondary winding.

The section view in FIG. 1D shows the area around the bridge 132. Owing to the trench structure in FIG. 1D can increase the coupling area between the primary winding and the secondary winding, therefore in another embodiment of the present invention the section view in FIG. 1D can be applied in other area where has no bridges. In the other words, the bridge 132 in FIG. 1D can be replaced by a tertiary winding which is electrically connected to the segment 112 of the primary winding, that is a portion of the tertiary windings can be connected to the primary winding through the bridges or via holes to form the primary inductor, and a portion of the tertiary windings can be connected to the secondary winding to form the secondary inductor, and the portion of the tertiary windings connected to the primary winding and the portion connected to the secondary winding can form a trench structure which is shown in FIG. 1D to increase the coupling area between the primary inductor and the secondary inductor and/or decrease the coupling distance between the primary inductor and the secondary inductor. These alternative designs shall fall within the scope of this invention.

Figure 2A:
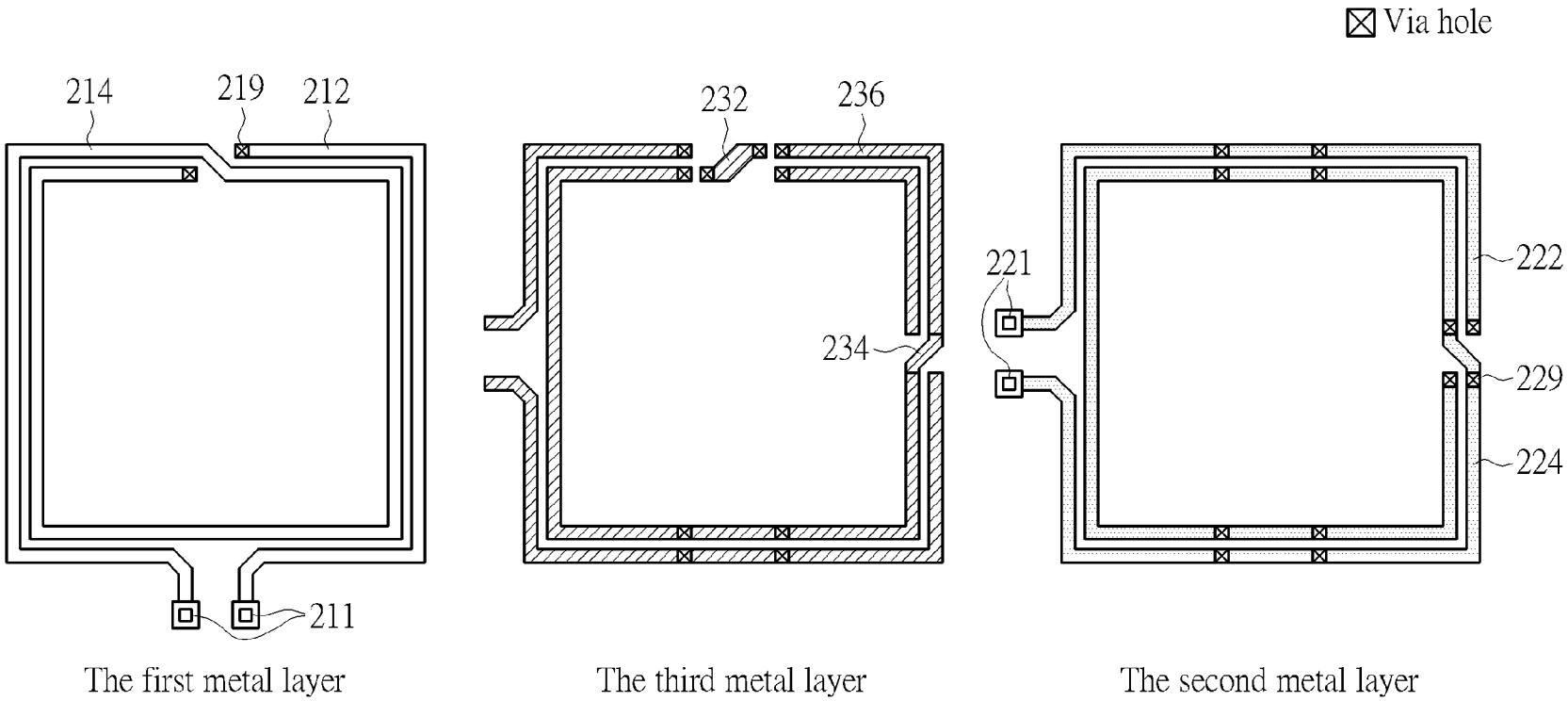
FIG. 2A is a diagram illustrating the patterns of three metal layers of integrated stacked transformer according to another embodiment of the present invention.
Figure 2B:
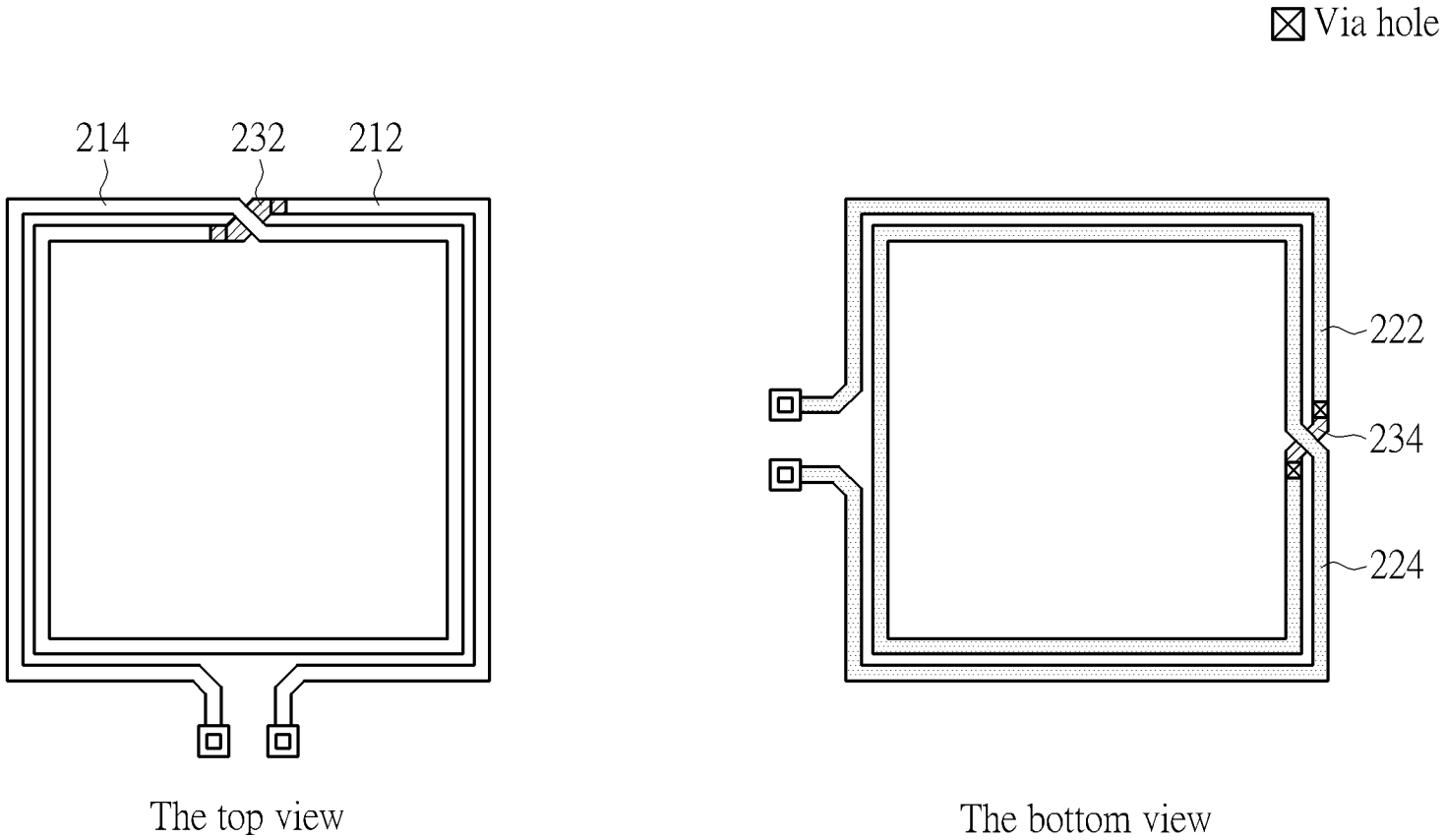
FIG. 2B is a diagram illustrating the top view and the bottom view of the integrated stack transformer in FIG. 2A.

The integrated stacked transformers in FIG. 1A and FIG. 1B are four turns, however, in other embodiments of the present invention the integrated stacked transformers can have different turns. Refer to FIG. 2A and FIG. 2B, wherein FIG. 2A is a diagram illustrating the patterns of three metal layers of the integrated stacked transformer according to an embodiment of the present invention. FIG. 2B is a diagram illustrating the top view and the bottom view of the integrated stacked transformer according to an embodiment of the present invention. The integrated stacked transformer in this embodiment can be applied to be a transformer or balun in radio frequency integrated circuit for example.

Refer to FIG. 2A, the integrated stacked transformer is formed by three metal layers, wherein the diagram of the first metal layer in FIG. 2A is a primary winding, and the primary winding comprises two input/output ports 211 and a plurality of segments 212 and 214 that are not connected to each other, where each segment comprises at least one via hole 219. The diagram of the second metal layer in FIG. 2A is a secondary winding, and the secondary winding comprises two input/output ports 221 and a plurality of segments 222 and 224 that are not connected to each other, where each segment comprises at least one via hole such as the via hole 229 in FIG. 2A. In addition, the diagram of the third metal layer comprises a plurality of bridges, for example the bridges 232 and 234 in FIG. 2A, and a plurality of tertiary windings, for example the tertiary winding 236 in FIG. 2A. Furthermore, the third metal layer is disposed between the first metal layer and the second metal layer in this embodiment.

Next, refer to FIG. 2A and FIG. 2B, the segment 212 of the primary winding is connected to the bridge which is formed by the third metal layer (for example the bridge 232 in FIG. 2B) through via holes in the top view of FIG. 2B, and is electrically connected to the segment 214 through the bridge 232. The segments 212, 214, 216, 218 of the primary winding will be connected together through the connection of the bridge 232 to form a primary inductor.

In addition, the segment 222 of the secondary winding is electrically connected to the bridge which is formed by the third metal layer (for example the bridge 234 in FIG. 2B) through via holes in the bottom view of FIG. 2B, and is electrically connected to the segment 224 through the bridge 234. The segments 222, 224 will be connected together through the connection of the bridge 234 to form a secondary inductor, wherein the secondary inductor is electrically isolated from the primary inductor.

In the top view of FIG. 2B, it only depicts the primary winding and the third metal layer which is directly connected to the primary winding but the second metal layer and the entire third metal layer for the tidiness of figure. In the bottom view of FIG. 2B, it also only depicts the secondary winding and the third metal layer which is directly connected to the secondary winding but the first metal layer and the entire third metal layer for the same reason. The windings in the first metal layer, the second metal layer and the third metal layer of the integrated stacked transformer in FIG. 2A are overlapped except the bridges and the input/output ports in this embodiment.

Like the integrated stacked transformers in FIG. 1A, FIG. 1B and FIG. 1C, the bridges of the integrated stacked transformer which are connected to either the primary winding or the secondary winding are manufactured by the same metal layer (i.e. the third metal layer), therefore the integrated stacked transformer in this embodiment can be achieved with only three metal layers, which can reduce the manufacturing costs indeed. In addition, refer to the statements of FIG. 1A, FIG. 1B and FIG. 1C, the designs of the integrated stacked transformers in FIG. 2A and FIG. 2B can also have the corresponding adjustments. For example the tertiary winding 236 in FIG. 2A and FIG. 2B can be removed and the structure in FIG. 1D can be applied in other area where has no bridges. The technicians in this field can comprehend how to adjust the integrated stacked transformer in FIG. 2A and FIG. 2B after reading the embodiments and the possible alternative designs which are stated in FIG. 1A, FIG. 1B and FIG. 1C therefore the adjustments of FIG. 2A and FIG. 2B are omitted here for the brevity.

In addition, in other embodiments of the present invention the turn ratio of the primary winding and the secondary winding of integrated stacked transformer is not limited to 1:1 (can also be 1:2, 2:3, or n:m). These alternative designs are supposed to be defined in the scope of the present invention.

In addition, the shapes of windings are all squares in the embodiments of FIG. 1A, FIG. 1B, FIG. 2A and FIG. 2B. However, in other embodiments of the present invention, the shapes of windings can be hexagonal, octagon or circle. These adjustments of design are supposed to be defined in the range of the present invention.

In addition, the integrated stacked transformers of FIG. 1A, FIG. 1B, FIG. 2A and FIG. 2B can also dispose the center taps.

Figure 3A:
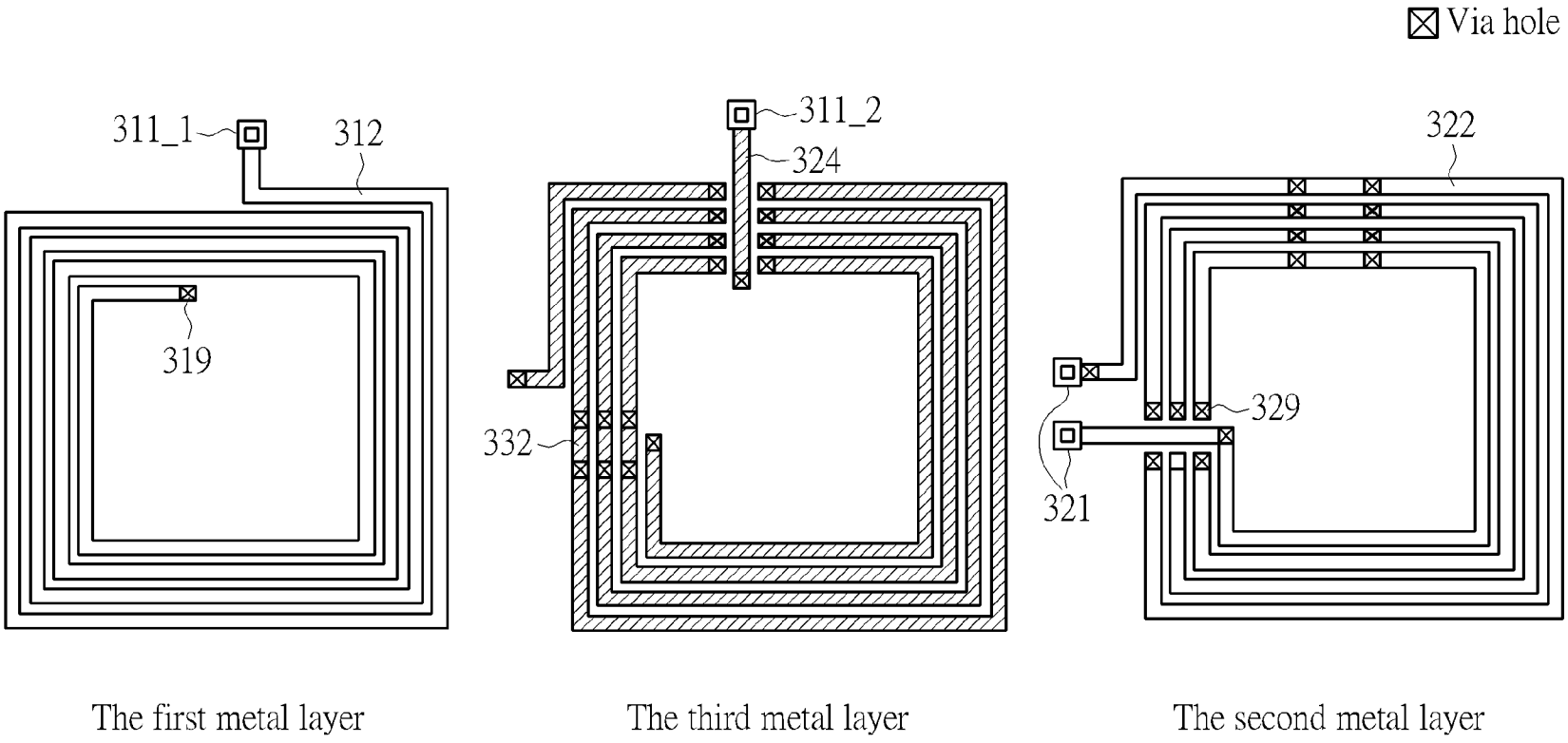
FIG. 3A is a diagram illustrating the patterns of three metal layers of integrated stacked transformer according to another embodiment of the present invention.
Figure 3B:
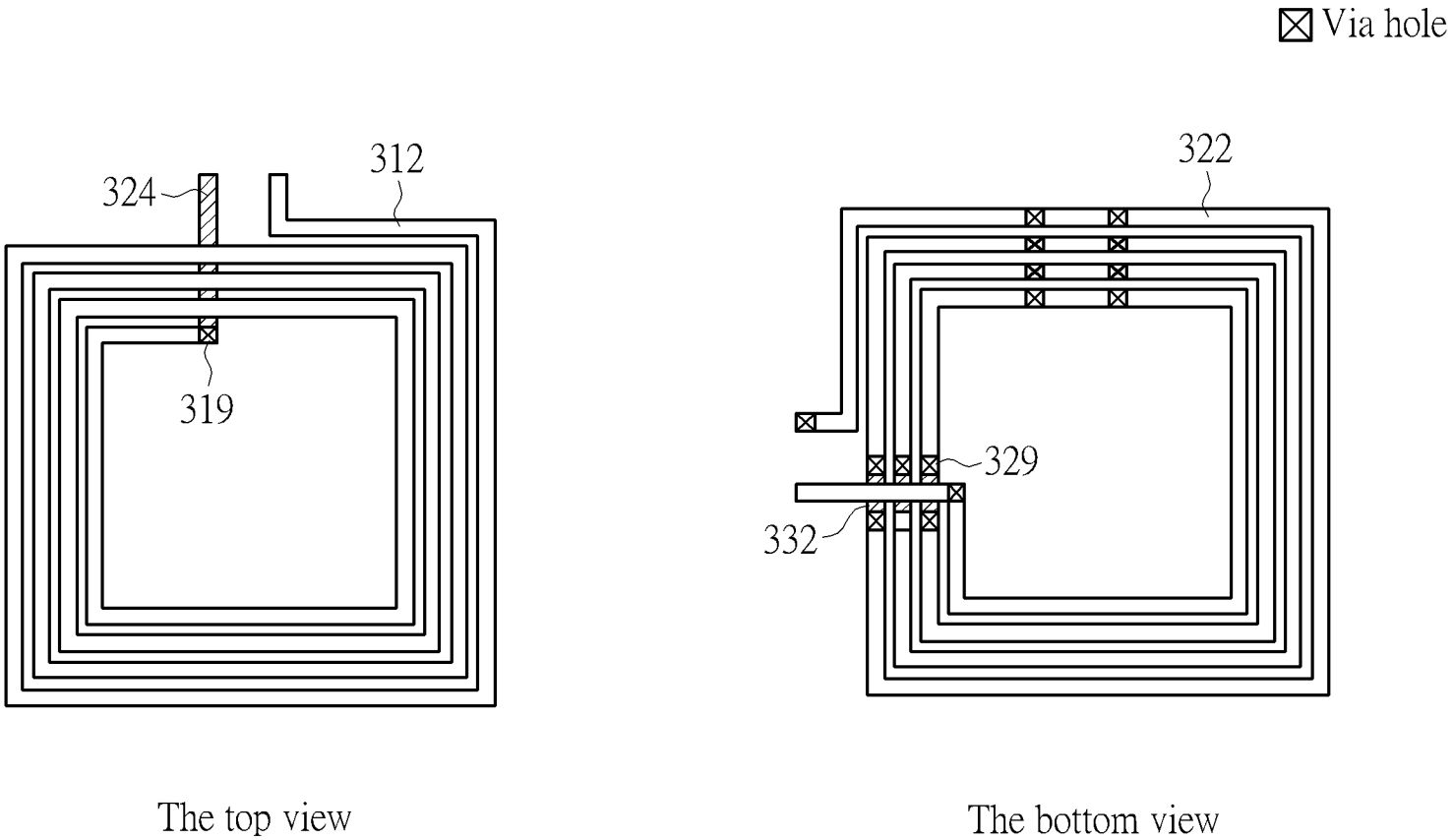
FIG. 3B is a diagram illustrating the top view and the bottom view of the integrated stack transformer in FIG. 3A.

The primary windings and the secondary windings of integrated stacked transformers in FIG. 1A, FIG. 1B, FIG. 2A and FIG. 2B are symmetric type winding, however, in other embodiments of the present invention, the primary winding and the secondary winding of integrated stacked transformers can be asymmetric type winding. Refer to FIG. 3A and FIG. 3B, wherein FIG. 3A is a diagram illustrating the patterns of three metal layers of the integrated stacked transformer according to an embodiment of the present invention, FIG. 3B is the top view and the bottom view of the integrated stacked transformer according to the embodiment of the present invention. The integrated stacked transformer in this embodiment of the present invention can be applied to be a transformer or balun in radio frequency integrated circuit.

Refer to FIG. 3A, the integrated stacked transformer is formed by three metal layers, wherein the diagram of the first metal layer in FIG. 3A is a primary winding 312, and the primary winding is spiral winding (asymmetric type winding) and comprises an input/output port 311_1. The diagram of the second metal layer in FIG. 3A is a secondary winding 322 and comprises two input/output ports 321 and a plurality of segments that are not electrically connected to each other, where each segment comprises at least one via hole, for example the via hole 329 in FIG. 3A. The secondary winding 322 is spiral winding as well (asymmetric type winding). In addition, the diagram of the third metal layer in FIG. 3A comprises a plurality of tertiary windings, for example the tertiary windings 322 and 324, wherein the tertiary winding 324 comprises the other input/output port 311_2 which is corresponding to the input/output port 311_1 of the primary winding. The third metal layer is disposed between the first metal layer and the second metal layer in this embodiment.

Next, refer to FIG. 3A and FIG. 3B, the primary winding 312 is electrically connected to the tertiary winding 324 formed by the third metal layer through via hole 319 in the top view of the FIG. 3B, and the primary winding 312 and the tertiary winding 324 will be connected together to form a primary inductor through the connection of the tertiary winding 324.

In addition, a segment of the secondary winding is electrically connected to the bridges (for example the bridges 332 in FIG. 3B) which is formed by the third metal layer through via hole in the bottom view of FIG. 3B, and the segment is connected to another segment of the secondary winding through the bridges. The segments of the secondary winding will be connected together to form a secondary inductor, wherein the secondary inductor is electrically isolated from the primary inductor.

In the top view of FIG. 3B, it only depicts the primary winding and the third metal layer which is directly connected to the primary winding but the secondary winding and the entire third metal layer for tidiness of figure. In the bottom view of FIG. 3B, it also only depicts the secondary winding and the third metal layer which is directly connected to the secondary winding but the first metal layer and the entire third metal layer for the same reason. The windings in the first metal layer, the second metal and the third metal layer of the integrated stacked transformer in this embodiment are overlapped except the bridges and the input/output ports.

The integrated stacked transformers in FIG. 3A and FIG. 3B are four turns, however, in other embodiments of the present invention the integrated stacked transformer can have different turns, for example two turns. This adjustment of design is supposed to be defined in the scope of the present invention.

Like the integrated stacked transformers in FIG. 1A, FIG. 1B, FIG. 1C, FIG. 2A and FIG. 2B, the primary winding and the tertiary winding which is connected to the secondary winding and the bridge of the integrated stacked transformers in FIG. 3A and FIG. 3B are formed by the same metal layer (i.e. the third metal layer), therefore the integrated stacked transformer in this embodiment can be achieved by only three metal layers, which can reduce manufacturing costs indeed. In addition, refer to the statements of FIG. 1A, FIG. 1B and FIG. 1C, the integrated stacked transformers in FIG. 3A, FIG. 3B and FIG. 3C can also have the corresponding adjustments, for example the tertiary windings 332 in FIG. 3A and FIG. 3B can be removed and the structure in FIG. 1D can be applied in other area where has no bridges. The technicians in this field can comprehend how to adjust the integrated stacked transformers in FIG. 3A and FIG. 3B after reading the embodiments and the possible adjustments which are stated in FIG. 1A, FIG. 1B, and FIG. 1C, therefore the adjustments are omitted here for brevity.

The primary winding and the secondary winding of the integrated stacked transformers which are disclosed in FIG. 1A, FIG. 1B, FIG. 2A and FIG. 2B are all symmetric type winding but the primary winding and the secondary winding of the integrated stacked transformer in FIG. 3A and FIG. 3B are all asymmetric type winding. However, in another embodiment of the present invention, one of the primary winding and the secondary winding of the integrated stacked transformer can be symmetric type winding and the other can be asymmetric type winding. The technicians in this field can comprehend how to adjust the integrated stacked transformers after reading the embodiments which are stated in FIG. 1A, FIG. 1B, FIG. 1C, FIG. 2A, FIG. 2B, FIG. 3A and FIG. 3B, therefore the adjustments are omitted here for brevity.

Figure 4A:
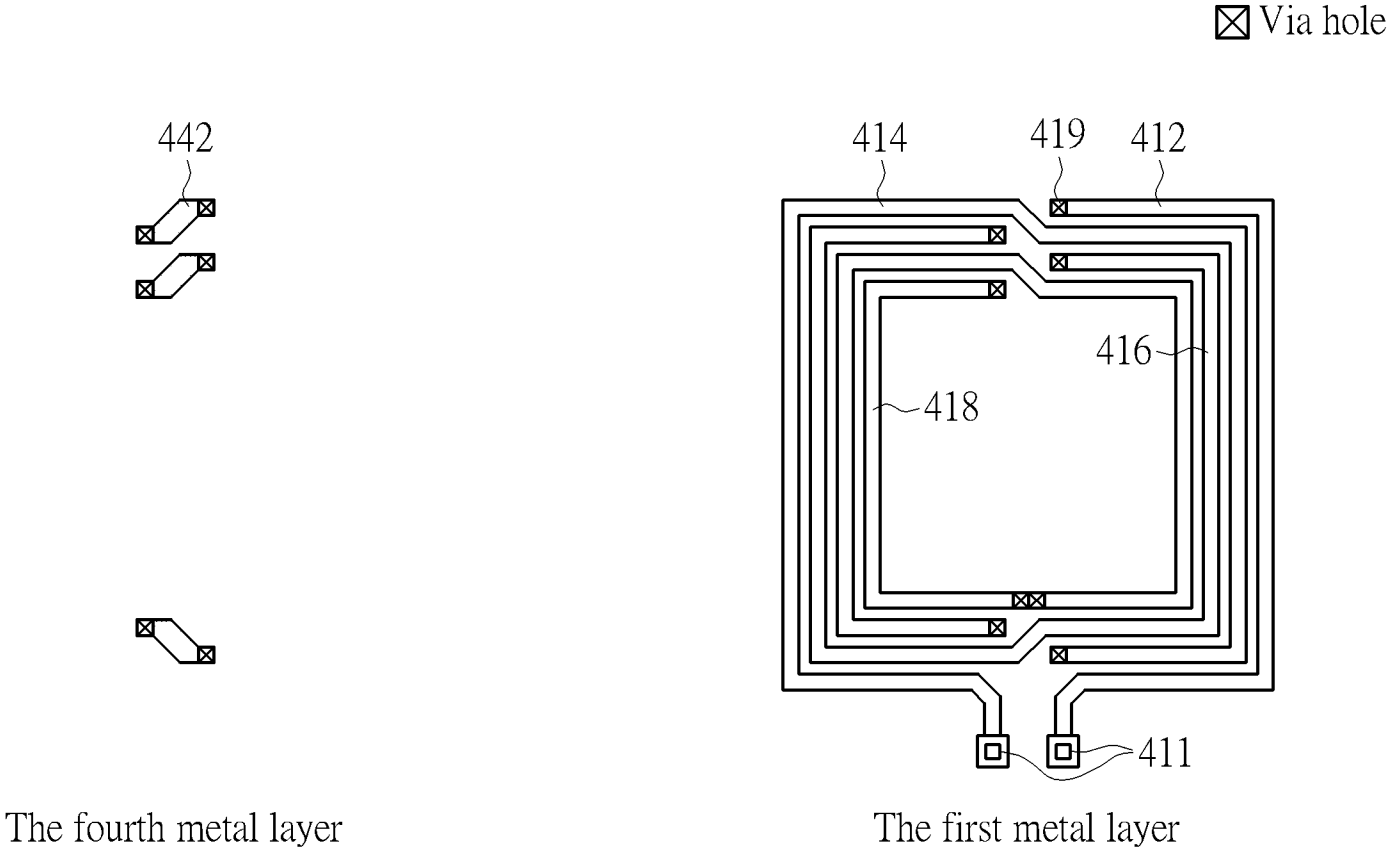
FIG. 4A and FIG. 4B are diagrams illustrating the patterns of four metal layers of integrated stacked transformer according to an embodiment of the present invention.
Figure 4B:
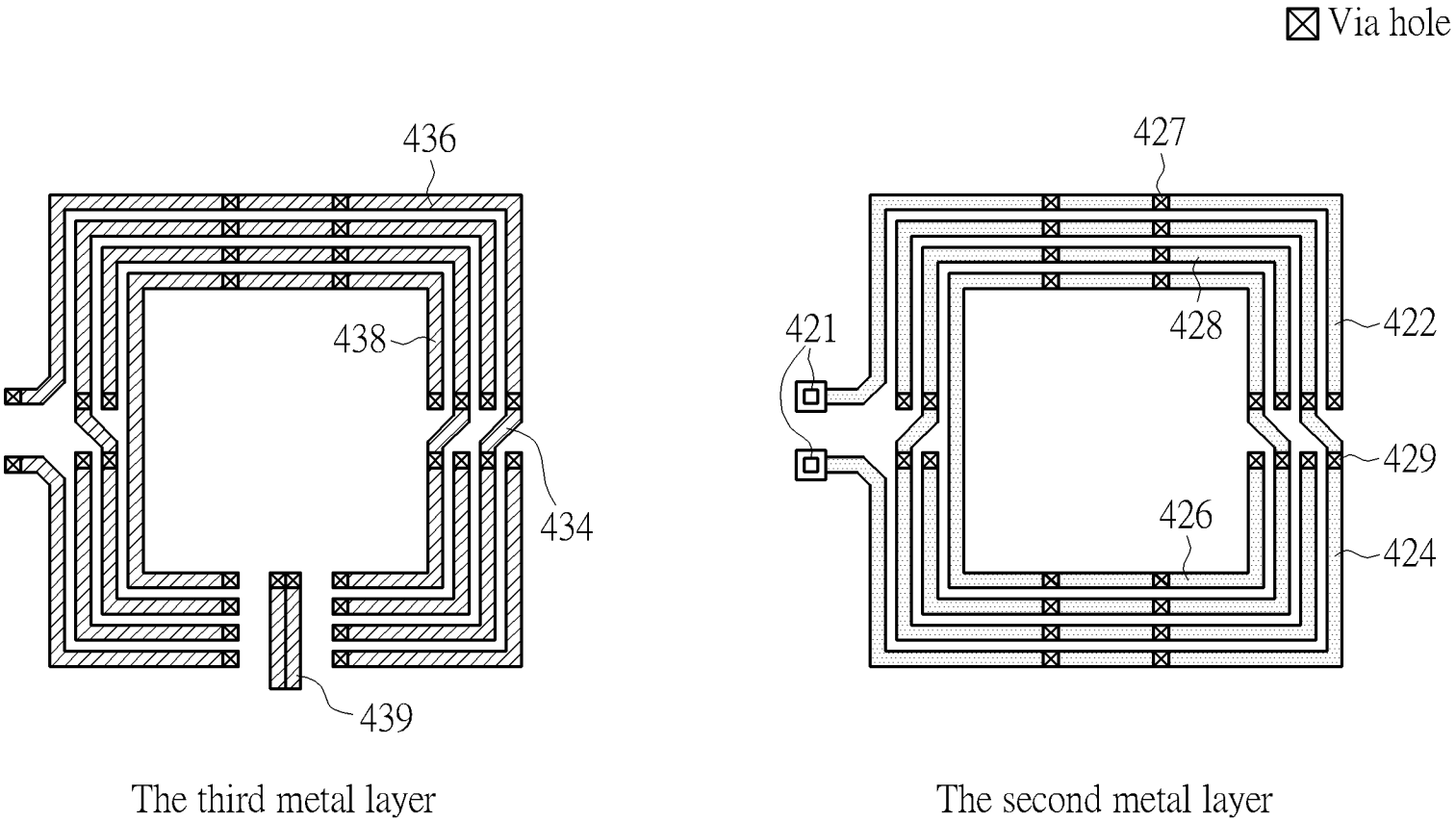
Figure 4C:
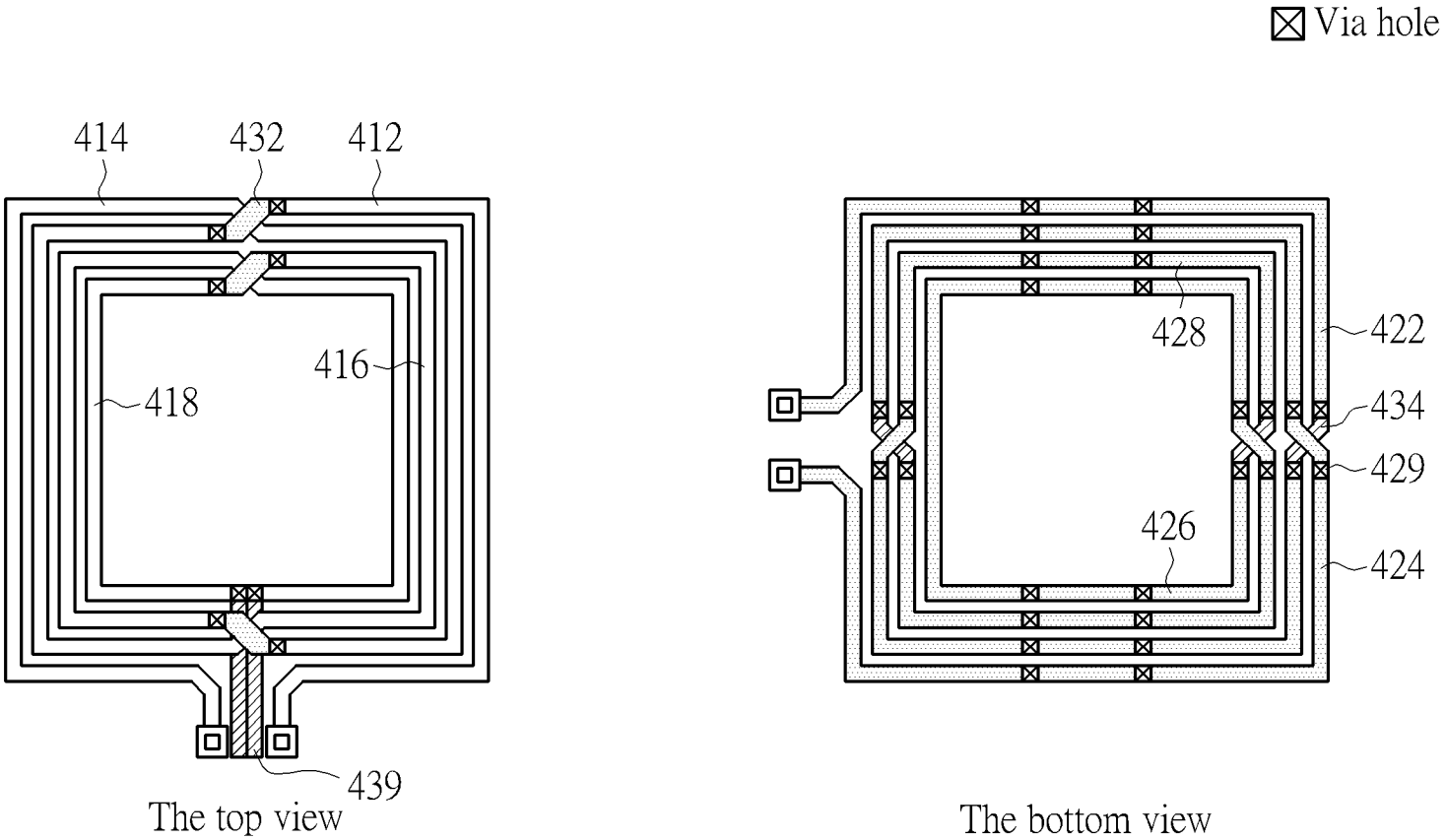
FIG. 4C is a diagram illustrating the top view and the bottom view of the integrated stack transformer in FIG. 4A and FIG. 4B.

In addition, refer to FIG. 4A, FIG. 4B and FIG. 4C, wherein FIG. 4A and FIG. 4B are the patterns of the four metal layers of the integrated stacked transformer according to an embodiment of the present invention, and FIG. 4C is a diagram illustrating the top view and the bottom view of the integrated stacked transformer according to an embodiment of the present invention. The integrated stacked transformer in this embodiment can be applied to be a transformer or balun in radio frequency integrated circuit.

The integrated stacked transformer in this embodiment, refer to FIG. 4A and FIG. 4B, which is formed by four metal layers, wherein the diagram of the first metal layer in FIG. 4A is a primary winding and comprises two input/output ports 411 and a plurality of segments 412, 414, 416, 418 that are not connected to each other, where each segment comprises at least one via hole 419; the diagram of the second metal layer in FIG. 4B is a secondary winding and comprises two input/output ports 421 and a plurality of segments 422, 424, 426, 428 that are not connected to each other, where each segment comprises at least one via hole, for example the via holes 427 and 429 in FIG. 4B. The diagram of the third metal layer in FIG. 4B comprises a plurality of bridges (for example the bridges 432 and 434) and a plurality of tertiary windings (for example the tertiary windings 436, 438 and 439), wherein the tertiary winding 439 is a center tap; In addition, the diagram of the fourth metal layer in FIG. 4A comprises a plurality of bridges 442. In this embodiment the metal layers of the integrated stacked transformer from the top to the bottom are the fourth metal layer, the first metal layer, the third metal layer and the second metal layer respectively.

Next, refer to FIG. 4A, FIG. 4B and FIG. 4C, each segment 412, 414, 416, 418 of the primary winding is connected to the bridges which are formed by the fourth metal layer (for example the bridges 442) and is electrically connected to another segment of the primary winding through the bridges respectively. For example the segment 412 is electrically connected the segment 416 through the bridge 442 in FIG. 4A. The segments 412, 414, 416, and 416 of the primary winding will be connected together through the connection of the bridges to form a primary inductor. In addition, the primary winding is connected to the tertiary winding 439 (the center tap) which is formed by the third metal layer through via holes.

In addition, in the bottom view of FIG. 4C, each segment 422, 424, 426 and 428 is electrically connected to the bridges which are formed by the third metal layer (for example the bridge 434) through via holes respectively. For example the segment 422 is electrically connected to the segment 428 through the bridge 434. The segments 422, 424, 426, 428 of the secondary winding will be connected together through the connection of the bridges to form a secondary inductor, wherein the secondary inductor is electrically isolated from the primary inductor.

In addition, it only depicts the primary winding and the third metal layer and the fourth metal layer which are directly connected to the primary winding but the second metal layer and the entire third metal layer in the top view of the FIG. 4C for the tidiness of figure. In the bottom view of the FIG. 4C, it also only depicts the secondary winding and the third metal layer which is directly connected to the secondary winding but the primary winding, the fourth metal layer and the entire third metal layer for the same reason. The windings in the first metal layer, the second metal layer and the third metal layer of the integrated stacked transformers in FIG. 4A and FIG. 4B are overlapped except the bridges, the input/output ports and the center tap in this embodiment.

Although the embodiment in FIG. 4A, FIG. 4B and FIG. 4C uses the extra fourth metal layer comparing to the embodiment in FIG. 1A, FIG. 1B and FIG. 1C, this design can reduce the series resistance of the primary winding additionally and the third metal layer can be used as the center tap of the primary winding.

In addition, refer to the statements of FIG. 1A, FIG. 1B and FIG. 1C, the integrated stacked transformers in FIG. 4A, FIG. 4B and FIG. 4C can have the corresponding adjustments, for example the tertiary winding 432 in FIG. 4C can be removed and the structure in FIG. 1D can be applied in the other area where has no bridges. The technicians in this field can comprehend how to adjust the integrated stacked transformers in FIG. 4A, FIG. 4B and FIG. 4C after reading the embodiments and the possible adjustments which are stated in FIG. 1A, FIG. 1B, and FIG. 1C, therefore the adjustments are omitted here for brevity.

Briefly summarized, the integrated stacked transformer in the present invention uses the same metal layer as the bridges of the primary winding and the secondary winding, therefore the integrated stacked transformer can be achieved by less metal layers. In addition, the metal layer which is used to be the bridges has trench structure, so integrated stacked transformer has the higher quality factor and the coupling coefficient.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated stacked transformer, comprising:

a primary winding, formed by a first metal layer, comprising a plurality of segments that are not connected to each other; and a secondary winding, formed by a second metal layer, comprising a plurality of segments that are not connected to each other; and a plurality of bridges formed by a third metal layer, a portion of the bridges is/are connected to the segments of the primary winding respectively to make the segments of the first winding form a primary inductor; and another portion of the bridges is/are connected to the segments of the secondary winding to make the segments of the second winding form a secondary inductor that is electrically isolated from the primary inductor.

2. The integrated stacked transformer of claim 1, further comprising:

a tertiary winding formed by the third metal layer, two terminals of the tertiary winding are connected to one of the segments of the secondary winding respectively through via holes.

3. The integrated stacked transformer of claim 2, wherein the two terminals of the tertiary winding are connected to a part of the one of the segments of the secondary winding through the via holes, respectively, and a pattern of the tertiary winding is identical with a pattern of the part.

4. The integrated stacked transformer of claim 1, further comprising:

a plurality of tertiary windings formed by the third metal layer, and two terminals of each tertiary winding are connected to one of the segments of the secondary winding through via poles, respectively;

wherein patterns of the tertiary windings are identical with a pattern of the secondary winding except patterns around the bridges.

5. The integrated stacked transformer of claim 1, further comprising:

at least two tertiary windings formed by the third metal layer, one of the two tertiary windings is electrically connected to the primary winding, and the other is electrically connected to the secondary winding, and the two tertiary windings are electrically isolated from each other.

6. The integrated stacked transformer of claim 5, wherein the two tertiary windings are not bridges which are connected to either the segments of the primary winding or the segments of the secondary winding.

7. An integrated stacked transformer, comprising:

a primary winding formed by a first metal layer;

a secondary winding formed by the second metal layer; and at least two tertiary windings formed by a third metal layer, the third metal layer is disposed between the first metal layer and the second metal layer;

wherein one of the two tertiary windings is electrically connected to the primary winding to form a primary inductor, and the other is electrically connected to the secondary winding to form a secondary inductor, and the two tertiary windings are electrically isolated from each other.

8. The integrated stacked transformer of claim 7, wherein the primary winding comprises a plurality of segments that are not connected to each other, and the secondary winding comprises a plurality of segments that are not connected to each other, and the two tertiary windings are not bridges which are connected to either the segments of the primary winding or the segments of the secondary winding.

9. The integrated stacked transformer of claim 8, wherein the tertiary winding electrically connected to the secondary winding is connected to a part of one of the segments of the secondary winding through via holes, and a pattern of the tertiary winding is identical with a pattern of the part.

10. The integrated stacked transformer of claim 8, further comprising:

a plurality of bridges formed by the third metal layer, wherein a portion of the bridges are connected to the segments of the primary winding respectively to make the segments of the primary winding form a primary inductor; and another portion of the bridges is connected to the segments of the secondary winding to make the segments of the secondary winding form a secondary inductor.

11. The integrated stacked transformer of claim 8, wherein the tertiary winding which is electrically connected to the primary winding is a center tap.

* * * * *